US007713181B1

(12) United States Patent
Durham

(10) Patent No.: US 7,713,181 B1
(45) Date of Patent: May 11, 2010

(54) VERSATILE ABDOMINAL EXERCISE BED

(76) Inventor: Lorne Durham, 6417 Hawthorne St., Landover, MD (US) 20785

( * ) Notice: Subject to any disclaimer, the term of this patent is extended or adjusted under 35 U.S.C. 154(b) by 0 days.

(21) Appl. No.: 12/317,951

(22) Filed: Jan. 2, 2009

(51) Int. Cl.
*A63B 26/00* (2006.01)

(52) U.S. Cl. ..... 482/140; 482/142; 482/139

(58) Field of Classification Search ..... 482/140, 482/907, 91, 148, 139, 142, 62, 23, 51, 92–96, 482/63, 135–137
See application file for complete search history.

(56) References Cited

U.S. PATENT DOCUMENTS

| | | | | | |
|---|---|---|---|---|---|
| 1,695,689 | A | * | 12/1928 | Hulander | 482/128 |
| 3,012,776 | A | * | 12/1961 | Hotas | 482/94 |
| 3,362,090 | A | * | 1/1968 | Adam | 434/255 |
| 3,674,017 | A | * | 7/1972 | Stefani, Jr. | 601/26 |
| 3,767,191 | A | * | 10/1973 | Riley | 482/25 |
| 3,792,860 | A | * | 2/1974 | Selnes | 482/95 |
| 3,912,262 | A | * | 10/1975 | Micko | 482/23 |
| 4,098,502 | A | * | 7/1978 | Faust | 482/104 |
| 4,358,109 | A | * | 11/1982 | Schrems | 482/142 |
| 4,653,751 | A | * | 3/1987 | Green | 482/104 |
| 4,700,946 | A | * | 10/1987 | Breunig | 482/57 |
| 4,799,475 | A | * | 1/1989 | Iams et al. | 601/23 |
| 4,804,179 | A | * | 2/1989 | Murphy et al. | 482/97 |
| 4,834,072 | A | * | 5/1989 | Goodman | 601/35 |
| 4,838,547 | A | * | 6/1989 | Sterling | 482/128 |
| 4,846,465 | A | * | 7/1989 | Iams et al. | 482/132 |
| 4,948,124 | A | * | 8/1990 | Ghaly | 482/118 |
| 4,989,860 | A | * | 2/1991 | Iams et al. | 482/132 |
| 5,037,085 | A | * | 8/1991 | Wexler | 482/148 |
| 5,062,630 | A | * | 11/1991 | Nelson | 482/34 |
| 5,141,483 | A | * | 8/1992 | Smith | 482/142 |
| 5,232,426 | A | * | 8/1993 | Van Straaten | 482/123 |
| 5,279,533 | A | * | 1/1994 | Yin et al. | 482/147 |
| 5,306,223 | A | * | 4/1994 | Martinez | 482/142 |
| 5,462,509 | A | * | 10/1995 | Lister | 482/132 |
| 5,607,374 | A | * | 3/1997 | Hesse | 482/51 |
| 5,669,865 | A | * | 9/1997 | Gordon | 482/142 |
| 5,779,607 | A | * | 7/1998 | Harris | 482/140 |
| 5,947,876 | A | * | 9/1999 | Willey, II | 482/140 |
| 6,030,324 | A | * | 2/2000 | McBride | 482/142 |
| 6,090,022 | A | * | 7/2000 | Colecchi | 482/131 |
| 6,440,045 | B1 | * | 8/2002 | Gaston | 482/140 |
| 6,468,191 | B1 | * | 10/2002 | Cameron | 482/140 |
| 7,115,073 | B2 | * | 10/2006 | Nizamuddin | 482/51 |
| 2003/0199372 | A1 | * | 10/2003 | Robinson et al. | 482/140 |
| 2005/0143233 | A1 | * | 6/2005 | Shifferaw | 482/140 |
| 2005/0148449 | A1 | * | 7/2005 | Weir et al. | 482/142 |
| 2005/0181916 | A1 | * | 8/2005 | Frost et al. | 482/140 |
| 2005/0272581 | A1 | * | 12/2005 | Stearns | 482/140 |
| 2008/0051274 | A1 | * | 2/2008 | Greene | 482/142 |
| 2009/0054218 | A1 | * | 2/2009 | Tsai | 482/147 |

* cited by examiner

*Primary Examiner*—Lori Baker
(74) *Attorney, Agent, or Firm*—Richard L. Mikesell

(57) ABSTRACT

An exercise device which can be used to exercise the abdominal muscles of a user includes a base to which a lower body exercise portion and an upper body exercise portion are pivotably connected. The portions are hinged to provide versatility and to permit the device to be folded for storage. Wheels are swivably connected to the device and support the device on a support surface for use. The hinges, pivot connections and swivel wheels permit the device to be placed in a wide variety of orientations and positions whereby a wide variety of exercises can be performed.

10 Claims, 1 Drawing Sheet

VERSATILE ABDOMINAL EXERCISE BED

TECHNICAL FIELD OF THE INVENTION

Figure 1:
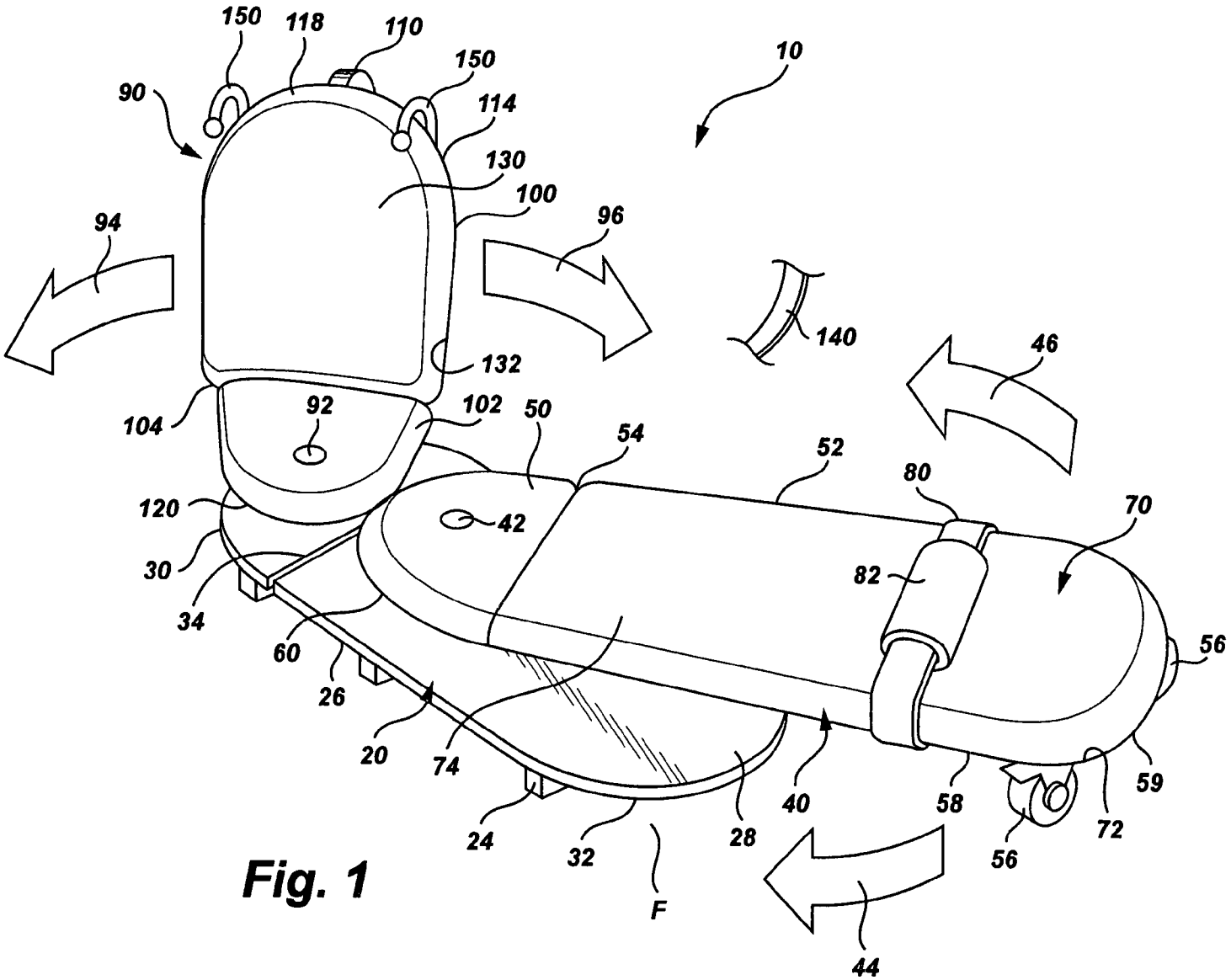

The present invention relates to the general art of exercise devices, and to the particular field of abdominal exercise devices.

BACKGROUND OF THE INVENTION

In recent years, the trend to urbanization and mechanization of our society has been a factor in decreasing the amount of exercise in which society members engage. Physician and fitness experts nowadays are concerned with good health and a regular program of physical exercise for all ages. This problem is acute for the urban dweller residing in limited space areas and the elderly also facing these various problems. In an effort to provide home facilities to overcome lack of exercise area and provide an affordable means of obtaining a positive program of exercise activities, various knockdown and collapsible exercising devices have been introduced.

Most prior art devices have not been satisfactory in that collapsible devices must be stored to of sight and devices which store the exercise apparatus are bulky or cumbersome.

Still further, heretofore exercises for body or muscle building have required the use of several different types of benches and related components in order for the exerciser to work on strengthening all of his body muscles. These several units have generally comprised a sit-up board, a flat bench, an inclined bench, leg extension rollers, a declined bench, a deep-knee bench, a bench press, and means for dips. Heretofore, a few of these units have been combined in a single bench, for example, a flat bench can have a part movable from a flat position to an inclined position thus combining in one unit flat and inclined benches; or a flat bench can include leg extension rollers or a bench press, but until the present invention there has never been a body building bench which has incorporated all of the standard exercising units enumerated above A multiplicity of combination exercise devices are presently known and used.

The simplest of these combination devices are those which allow the performance of only a few exercises. They generally comprise a basic exercise bench which is usually adjustable with a leg exercise machine usually at the foot of the bench. Resistance weights can be attached to the leg machine depending upon the amount of resistance required by the user. Also a barbell support means is generally adapted to the machine. These devices limit the scope of the body exercises which can be performed.

The next class of combination multi-gym devices contain an additional attachment known as a dip bar attached to telescopic supports which can also be used as squat racks allowing for an increased number of exercises using a barbell supported by a saddle adjacent each of the dip bars. Although it is claimed by the manufacturers of these multi-gym devices that a persons whole body can be exercised with these machines they are not technologically advanced by comparison to the present invention as they do not provide the practical benefits of the free weight concept in body building. Modern day body building demands precision machines which can allow the resistance provided by the weights at each station to be correctly imposed commensurate with the abilities of a particular muscle when it is in a particular exercise mode. Improperly applied weight resistance can lead to a decrease in efficiency of muscle building from exercise.

The more advanced combination multi-gym devices also have attached to them a lat machine which in combination with dead weights at the end of a pulley allow exercise of muscles in the upper torso region of the body and in particular the arms.

The manufacturers and distributors of these lat machines boast simulated free weight motion of the resistance weights as the exercise is carried out, however, the desired concept in weight lifting and muscle building is actual rather than simulated free weight motion wherein drag from the dead weights which are usually pin weights is eliminated and counterweight resistance to the muscle is correctly applied.

The leg machines of the more simple combination multi-gym devices also rely on the dead weight principle to provide resistance for the leg muscles when performing the various leg exercises.

As with the lat machines of the prior art dead weight drag is also a problem with the leg machine as the resistance is not efficiently applied to the leg muscles throughout the range of motion.

In weightlifting exercises, the inertia or inertial resistance of the weight load must first be overcome before the exercise progresses.

Ideally, the resistance weight should be no heavier than the maximum force of the weakest muscle acting in the particular exercise movement to be accomplished.

During an exercise, the amount of force generated during contraction of the muscle varies throughout all the phases of the movement. Consequently, the maximum level of strength of the muscle occurs close to full contraction. In the prior art exercise machines it has been found that for certain exercises, the drag is at a maximum at the commencement of a muscle exercise, when the muscle is usually extended and thus at its weakest. This phenomenon is undesirable and its existence prevents physiologically efficient muscle building.

The presently known multi-gym devices do not allow application of the true free weight concept due to the geometry of the various machines incorporated in the overall device and due to the resistance weight functionality.

Among the more versatile combination multi-gym devices available there are those which incorporate facilities in most of the known stations for weight lifting exercises such as shoulder presses, chest presses, leg presses, leg extensions, leg curls, latisimus pull, chinning up, roman bench exercises, abdominal exercises, dip bar exercises, knee raisers and squatting exercises.

Although stations allowing these exercises and more are incorporated in known machines, these machines tend to be costly, space taking, and difficult to transport.

They are also large, cumbersome and complex devices and because of their size and complexity are generally used in commercial gymnasiums or health clubs and so consequently they are not suited for use in the domestic environment because of these features, unlike the present invention.

It is possible to obtain exercise devices which allow for the development and exercise of one area of the body but these devices do not constitute a full body exercise device which is the most desirable apparatus to have.

Folding exercise machines sometimes combine a number of the commonly known exercise machines such as the lat machine, the versatile bench, the leg machine and the barbell set for performing a large range of weight training exercises.

However, in order for such devices to be folded and stored a number of the elements of the device must be removed from the mainframe structure. This device is generally designed to be sold as a complete package or for assembly by the consumer and disassembly when transportation or removal is required.

Furthermore, these devices do not overcome the problem of initial weight drag due to friction and also due to the inertia of the weights, and do not provide for a variation in weight resistance throughout the exercise motion commensurate with muscle strength at a particular point in the exercise.

It is also undesirable to set up a lat machine for operation by the addition of weights on the end of a pulley for the aforesaid reasons, as this results in a linear force application against which the exerciser must work.

Therefore, there is a need for a versatile exercise device which overcomes the aforesaid problems by providing an improved combination exercise gymnasium of relatively simple construction suitable for use in the home or gymnasium and which is foldable into a compact and portable unit adapted with wheels, and which combines the various machines suitable for exercising all zones of the body and which has improved configurational and operational geometry such that muscular improvement can be achieved in the most efficient manner as a result of correct or constant weight resistance application during particular exercises.

The modern trend in serious (e.g., competitive and commercial grade) exercise equipment is to have many different exercise units, each of which is specialized for a particular exercise. These are usually either non-adjustable, or are so inconvenient to adjust that they are adjusted only occasionally (i.e., upon set-up, or once per workout). Many of them just do not provide for quick readjustment during a particular working session or for multiple exercises at the same station. For example, a typical power bench is a simple, non-adjustable, flat bench, having a tipover bar, and designed just for flat bench presses.

Multiple-function benches are also known, of course. However, the additional functions which are available on such units are usually obtained at the expense of sturdiness and/or versatility. That is, in order to combine several functions into a single unit, prior art solutions have often been forced to accept certain user limitations. This means that the utility of such units for serious weight lifting can be greatly compromised. This can be seen from the fact that most commercial equipment, as has been discussed above, continues to be single-function—even though equipping a gym with such equipment can be far more expensive than would be necessary if suitable multi-functional equipment could be found.

A need therefore remains for a heavy duty exercise bench which, in a single, integrated unit, can function as an easily adjustable and versatile bench readily suited for many different exercises, different exercise weights, and different body sizes.

SUMMARY OF THE INVENTION

Some forms of exercise require the body to assume a sitting position, whereas other exercises require the body to be reclined, either horizontally or at an inclination to the horizontal. The apparatus constructed according to the invention enables the body to be located in any selected one of these positions without necessitating dismantling or replacement of any of the component parts of the apparatus. In this manner, the apparatus moves in different directions to stimulate abdomen muscles and offers a variety of positions (as many as 50 positions). The device can be used while the user lies on his side, on his back or on his stomach.

The device of the present invention works by targeting all the muscles in the midsection directly without putting any stress on the user's lower back. The device develops stronger, firmer, tighter, toner abs and a smaller waistline. The device creates strong firm tight muscles in the midsection (abdominals and lower back) of the body, it also helps strengthen the lower back, buttocks, and hamstrings. It does this by putting little to no stress on the lower back.

The device of the present invention achieves these goals by being able to move in a variety of ways while an individual is lying on it by being on their back, side, or stomach, The device swings to the left and right for the lower half and for the upper half and this can also be done simultaneously with the upper and lower halves, The device lifts on either half alternately or at the same time. The center of the device sits on a hinge plate which allows forward lifts for the lower and upper half of the bed. The center of the device has a rotating seat that allows one to turn in any direction from whichever position they lay. The device also has a wheel on the upper half and two wheels on the lower half, this is for easier gliding like movements. The wheels can be lock or unlock for taming in any direction. Wide cushioned. Velcro foot straps provide security and comfort. A cushioned bed platform provides comfort and expands in length for the different height of people. There are also tension bands to add resistance as one get stronger.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURE are not necessarily to scale, emphasis instead being placed upon illustrating the principles of the invention. Moreover, in the FIGURE, like referenced numerals designate corresponding parts throughout the view.

FIG. 1 is a perspective view of a exercise device embodying the principles of the present invention.

DETAILED DESCRIPTION OF THE INVENTION

Referring to the FIGURE, it can be understood that the present invention is embodied in an abdominal exercise bed 10 which can be easily adjusted to facilitate a wide variety of exercises. Bed 10 includes a base 20 which has stabilizers 24 on a lower surface 26 thereof which rest on a support surface, such as a floor F, when in use. A top surface 28 is presented upwardly when the bed is in use. Base 20 is divided into a first portion 30 and a second portion 32 by a hinge 34 which permits the base to be folded up for storage.

A lower body exercise portion 40 is connected to second portion 32 of the base portion adjacent to hinge 34 by a pivot connection 42 so the lower body exercise portion can pivot with respect to the base portion in directions indicated by arrows 44 and 46. Portion 40 has a first section 50 connected to a second section 52 by a hinge 54 whereby second section 52 can be moved with respect to first section 50 to fold lower body exercise portion 40 for storage of device 10. Wheels 56 are mounted on lower surface 58 of portion 40 adjacent to end 59 to mount portion 40 on the support surface when in use. Wheels 56 are mounted on portion 40 to swivel so portion 40 can move in the directions 44 and 46 when in a deployed, use, condition. This will permit a user to orient portion 40 in any orientation necessary to carry out the desired exercise. Hinge 54 is located adjacent to end 60 of portion 40 which is located adjacent to second portion 32 of base portion 20. A pad 70 is positioned on upper surface 72 of lower portion 40 so a user is comfortably supported on top surface 74 thereof and a strap 80 is used to attach a user's legs to lower portion 40 during exercise. Strap 80 includes a connection element 82 that is adjustable so the user can establish any suitable degree of attachment between his or her legs and device 10 for a variety of positions, including lying on the user's back, side or stomach.

An upper body exercise portion 90 is connected to base portion 20 adjacent to hinge 34 by a pivot connection 92 so the upper body exercise portion can pivot with respect to the base portion in directions indicated by arrows 94 and 96. Portion 90 has a first section 100 connected to a second section 102 by a hinge 104 whereby second section 102 can be moved with respect to first section 100 to fold upper body exercise portion 90 for storage. Wheel 110 is mounted on a lower surface 114 of portion 90 adjacent to end 118 to mount portion 90 on the support surface for use in carrying out certain exercises. Wheel 110 is mounted on portion 90 to swivel so portion 90 can move in the directions 94 and 96 with respect to base 20 when desired to orient portion 90 with respect to base 20 for a selected exercise. Hinge 104 is located adjacent to an end 120 of portion 90 which is located adjacent to hinge 34. A pad 130 is positioned on upper surface 132 of portion 90 so a user is comfortable when using device 10. As can be understood from the FIGURE, portion 90 can be folded about hinge 104 into a right angle for some exercises and can be oriented into a planar configuration for other exercises.

The hinges and pivots as well as the swivel wheels permit device 10 to be configured in a great variety of ways whereby a multiplicity of exercises can be performed using a single device. The hinges also permit the device to be folded up for storage while being easily unfolded for use.

Tension bands, indicated by band 140, can be added to the device for use as a user gets stronger and wishes to make exercises more difficult and shoulder straps 150 are located on portion 90 adjacent to end 118 to provide secure support for the user during exercise when desired.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. An exercise device comprising:

a base having a first section, a second section and a hinge connecting the first section to the second section;

a lower body exercise portion pivotably connected to the second section to pivot with respect to the second section, the lower body exercise portion including a first section and a second section and a hinge connecting the first section of the lower body exercise portion to the second section of the lower body exercise portion, said first section of the lower body portion being movable about the hinge with respect to the second section of the lower body portion; and an upper body exercise portion pivotably connected to the first section of the base to pivot about the main axis of the device and with respect to the first section, the upper body exercise portion including a first section and a second section and a hinge connecting the first section of the upper body exercise portion to the second section of the upper body exercise portion whereby the first section of the upper body portion being movable about the hinge with respect to the second section of the upper body portion.

2. The device defined in claim 1 wherein the base further includes stabilizers which engage a supporting surface.

3. The device defined in claim 2 wherein the upper body further includes a wheel which engages the supporting surface, the wheel on the upper body portion being swivel mounted on the upper body portion.

4. The device defined in claim 3 wherein the lower body further includes a wheel which engages the supporting surface, the wheel on the lower body portion being swivel mounted on the lower body portion.

5. The device defined in claim 4 wherein the lower body portion includes straps which engage a user legs when in use.

6. The device defined in claim 5 wherein the lower body portion includes pads which support the user.

7. The device defined in claim 6 wherein the hinge on the upper body portion is located adjacent to one end of the upper body portion.

8. The device defined in claim 7 wherein the hinge on the lower body portion is located adjacent to one end of the lower body portion.

9. The device defined in claim 8 further including a tension band which is connected to the device.

10. The device defined in claim 9 further including a shoulder strap on the upper body exercise portion.

* * * * *